US010898018B2

(12) United States Patent
Parinella

(10) Patent No.: US 10,898,018 B2
(45) Date of Patent: Jan. 26, 2021

(54) PORTABLE DEVICE FOR PROTECTING PERSONAL ITEMS WHILE KEEPING A BEVERAGE COLD

(71) Applicant: Rec-Creations, LLC, Austin, TX (US)

(72) Inventor: Nicholas Parinella, Austin, TX (US)

(73) Assignee: REC-CREATIONS, LLC, Austin, TX (US)

( * ) Notice: Subject to any disclaimer, the term of this patent is extended or adjusted under 35 U.S.C. 154(b) by 351 days.

(21) Appl. No.: 15/831,303

(22) Filed: Dec. 4, 2017

(65) Prior Publication Data

US 2018/0153326 A1 Jun. 7, 2018

Related U.S. Application Data

(60) Provisional application No. 62/429,599, filed on Dec. 2, 2016.

(51) Int. Cl.

| | |
|---|---|
| ***A45C 11/22*** | (2006.01) |
| ***A45C 11/32*** | (2006.01) |
| ***A47G 23/02*** | (2006.01) |
| ***A45C 11/18*** | (2006.01) |
| *A45F 5/00* | (2006.01) |

(52) U.S. Cl.

CPC ..... *A47G 23/0266* (2013.01); *A45C 11/18* (2013.01); *A45C 11/182* (2013.01); *A45C 11/22* (2013.01); *A45C 11/321* (2013.01); *A45F 2005/006* (2013.01); *A45F 2005/008* (2013.01); *A45F 2200/055* (2013.01); *A45F 2200/0583* (2013.01); *A47G 2023/0275* (2013.01)

(58) Field of Classification Search

CPC A45C 11/182; A45C 11/321; A45F 2005/025
USPC ..... 220/739
See application file for complete search history.

(56) References Cited

U.S. PATENT DOCUMENTS 8,047,364 B2 * 11/2011 Longinotti-Buitoni ..... A45C 11/00 206/320
2005/0279751 A1 * 12/2005 Dempsey ..... B65D 81/3876 220/739

(Continued)

*Primary Examiner* — Anthony D Stashick
*Assistant Examiner* — Raven Collins
(74) *Attorney, Agent, or Firm* — Hulsey P.C.

(57) ABSTRACT

A compartmented beverage koozie with a protective compartment that secures personal items while insulating a beverage includes a body defining a cylindrical interior that receives and maintains the temperature of the beverage. A curved plate forms a rigid mounting structure conforming to the cylindrical interior of the koozie. A water-resistant compartment forms an integral structure of the koozie. The water-resistant compartment receives and secures personal items in physical proximity to the koozie, while preventing or substantially reducing exposure of the personal items to water or other environmental effects. A water-resistant compartment pocket holds smaller personal items and a larger compartment for holds larger personal items. A transparent door shows the personal items protected within the water-resistant compartment. A door latch and gasket assembly establishes a water-resistant enclosure. The koozie is a foam structure preserving the thermal state of the beverage within the cylindrical interior. A D-ring permits single-attachment transport.

18 Claims, 5 Drawing Sheets

(56) References Cited

U.S. PATENT DOCUMENTS

| | | | | |
|---|---|---|---|---|
| 2007/0284264 | A1* | 12/2007 | Davis | A45C 11/182<br>206/39 |
| 2014/0251368 | A1* | 9/2014 | Lawson | A45C 11/00<br>132/287 |
| 2016/0213181 | A1* | 7/2016 | Gonzalez, II | B65D 23/0842 |
| 2017/0026070 | A1* | 1/2017 | Hodroj | H04B 1/3888 |

* cited by examiner

PORTABLE DEVICE FOR PROTECTING PERSONAL ITEMS WHILE KEEPING A BEVERAGE COLD

CROSS-REFERENCE TO RELATED APPLICATIONS

This application claims the benefit of the following provisional and non-provisional applications, all of which are here expressly incorporated by reference:

Ser. No. 62/429,599 entitled "BEVERAGE HOLDER APPARATUS INCLUDING STORAGE COMPARTMENT," filed on Dec. 2, 2016.

FIELD OF THE DISCLOSURE

This disclosure relates generally to a portable device for protecting personal items while keeping a beverage cold that includes a beverage holder apparatus including a compartmented beverage koozie with protective compartment for securing personal items.

BACKGROUND OF THE DISCLOSURE

Koozies are used to insulate a chilled beverage from warming by conduction and heat radiation, like a hand, warm air, warm surface, or sunlight. Using a koozie can reduce the rate a drink warms in the sun by up to 50%. Secondary uses include easily identifying one's beverage from another person's and for marketing. By imprinting on the koozie many different companies have used the koozie as a promotional giveaway because it is not only inexpensive to manufacture, but its frequent use is more likely to bring the company's name to a household presence. Originally a logo or image was screen-printed on a round foam cylinder with a foam base, which generally has a hole at the base to ease inserting and removing beverage containers.

For the purposes of interpreting the disclosure made herein, the name "Koozie" is a coined, trademarked term. The KOOZIE brand first started with the Radio Cap Corporation (RCC). RCC specialized in baseball caps. RCC registered a trademark for the name KOOZIE in 1980 and it introduced the Styrofoam can cooler in 1982. As the promotional product industry grew, more products were added to the KOOZIE brand, including drinkware, more styles of can coolers, cooler bags, outdoor leisure items, travel accessories and business accessories.

Other alternate names for can coolers are: "qoozie," "bawdle," "beach," "beer hugger," "beer huggie," "beer rubber," "beer sleeve," "bottle jacket," "can cooler," "candom," "coastie," "coldy-holdy," "kolder holder," "scungi," "coolie," "cozy," "drink sheath," "insulated can holder," "lovely pupper," "mopler," "stubby cooler," "stubby holder," and/or "tin can tauntaun." Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The koozie has evolved in both material and style. Materials used include leather, neoprene, EVA, polyester, vinyl, and various open-cell and closed-cell foams. There are koozies for 40 oz. bottles, and adjustable koozies that fit different beverage container sizes. Multiple koozies linked together have increased in popularity, giving the wearer a Rambo type look. The Bandie is such an example that allows the wearer to carry multiple cans in individually insulated koozies.

Now, when travelling to outdoor recreation areas that include water, individuals struggle with whether they should bring their wallets and/or purses for many reasons. When going to the beach or lake, it is all too common to have your belongings stolen or get your belongings wet or sandy. When floating the river, individuals attempt to minimize the number of items they carry since they can easily be dropped in the water. However, it may be necessary to have your I.D., a debit or credit card, or some cash handy in case of an emergency. It may also be necessary in case the individual wants to buy food, drinks, or other goods while near a beach or a river.

Additionally, it is also a hassle to carry a plurality of belongings to sporting events/tailgates and music-type festivals. Most people would prefer to carry the least number of items possible at these events to minimize the risk of losing important items or having the items stolen. Today, people are focused on efficiency. This includes minimizing inconveniences and risk. Carrying purses, wallets, and other personal items in public places falls under this category.

At rivers, beaches, pools, tailgates, sporting events, festivals, and other public places/events, beverages are a constant. Individuals always have something to drink, whether it's their favorite soda, a cold bottle of water, or a refreshing beer. To keep their drink cold (or their hand warm), most people put their drink in a beverage sleeve (can cooler, koozie, etc.). At all times, people may hold their drinks in their can coolers while enjoying the event. However, at these events, individuals may be surrounded by water, sand, mud, etc.; may be wearing dresses or shorts that do not have pockets; or may be attending events that do not allow purses or bags. Wallets and purses, may contain important items such as credit cards, I.D.'s, photos, business cards, gift cards, cash, social security cards, and many other important items. However, only a few of these items may be necessary at a specific event. To minimize the risk of having all these items lost, stolen, or ruined by water, mud, or sand (including expensive purses, bags and wallets), a device that allows for secure storage of these items is needed.

The disclosed subject matter helps to avoid these and other problems.

SUMMARY OF THE DISCLOSURE

This disclosure relates generally to a portable device for protecting personal items while keeping a beverage cold that includes a beverage holder apparatus including a compartmented beverage koozie with protective compartment for securing personal items. More specifically, the present disclosure delineates a method for securing personal items in proximity to a compartmented beverage koozie with protection against water or other environment effects. Even more broadly, the present disclosure provides a portable system for securing personal items in proximity to a compartmented beverage koozie with protection against water or other environment effects.

According to the teachings of the present disclosure, here is provided a compartmented beverage koozie with a protective compartment that secures personal items while insulating a beverage. The koozie includes a body with a bottom and a cylindrical vertical side defining a cylindrical interior that receives and maintains the temperature of the beverage.

A curved plate forms a rigid mounting structure conforming to the cylindrical interior of the koozie. A cylindrical vertical side opening exposes the curved plate. A water-resistant compartment includes a height not greater than the approximate height of the cylindrical vertical side and a curved exterior side conforming to the curvature of the curved plate. This joins the curved exterior side through the cylindrical vertical side opening to form thereby the water-resistant compartment as an integral structure of the koozie. The water-resistant compartment of sufficient size to receive and secure personal items and retain the personal items in physical proximity to the koozie, while preventing or substantially reducing exposure of the personal items to water or other environmental effects. The water-resistant compartment further includes a transparent door for showing the personal items protected within the water-resistant compartment and a gasket for preventing or substantially reducing water or other environment effects damage to the personal items protected by the water-resistant compartment. The water-resistant compartment further includes a door latch and gasket assembly for securely closing and establishing a water-resistant enclosure. The koozie further includes a resilient and compressible foam structure having a low thermal transfer coefficient for preserving the thermal state of the beverage within the cylindrical interior. The water-resistant compartment further includes a pocket for holding smaller personal items and a larger compartment for holding credit cards, paper money, and other larger personal items. A D-ring receives a tether or carabiner for permitting single-attachment transport of said compartmented beverage koozie.

The compartmented beverage koozie is ideal for holding cash, credit and debit cards, identification, house keys, some car keys, hotel cards/keys, essentially anything small that a person absolutely needs to have with him. Uses include on the beach, when tailgating, at the river, while fishing, when hiking, at the lake, camping, and on vacations. The compartmented beverage koozie is particularly well-suited for water, sand, snow, and dirt. It is made for all conditions.

In several embodiments, the compartmented beverage koozie is made of high-quality foam that is waterproof, non-absorbent, ultra-light-white, scratch and tear assistant, buoyant and anti-microbial. The compartmented beverage koozie is strong and durable for enduring all the challenges of nature, including fresh, salt, and chlorinated water, as well as mud, dirt and sand.

The compartmented beverage koozie includes a latch that ensures a watertight closure and security. The pocket keeps things in place while the door is opened or closed. A collapsible D-ring allows for attaching the compartmented beverage koozie to a lanyard or carabiner for easy and secure carrying. The compartmented beverage koozie may attach to a beach bag, backpack, and wrist lanyard. The D-ring comfortably folds into the compartmented beverage koozie side when not in use for maintaining a sleek design.

For the purposes of interpreting the disclosure made herein, the name "Koozie" is a coined, trademarked term. The KOOZIE brand first started with the Radio Cap Corporation (RCC). RCC specialized in baseball caps. RCC registered a trademark for the name KOOZIE in 1980 and it introduced the Styrofoam can cooler in 1982. As the promotional product industry grew, more products were added to the KOOZIE brand, including drinkware, more styles of can coolers, cooler bags, outdoor leisure items, travel accessories and business accessories.

Other alternate names for can coolers are: "qoozie," "bawdle," "beach," "beer hugger," "beer huggie," "beer rubber," "beer sleeve," "bottle jacket," "can cooler," "candom," "coastie," "coldy-holdy," "kolder holder," "scungi," "coolie," "cozy," "drink sheath," "insulated can holder," "lovely pupper," "mopler," "stubby cooler," "stubby holder," and/or "tin can tauntaun." Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Descriptions of certain illustrative aspects are described herein in connection with the FIGUREs. These aspects are indicative of various non-limiting ways in which the disclosed subject matter may be utilized, all of which are intended to be within the scope of the disclosed subject matter.

Other advantages, emerging properties, and features will become apparent from the following detailed disclosure when considered in conjunction with the associated FIGUREs that are also within the scope of the disclosure.

BRIEF DESCRIPTION OF THE DRAWINGS

The present subject matter will now be described in detail with reference to the drawings, which are provided as illustrative examples of the subject matter to enable those skilled in the art to practice the subject matter. Notably, the FIGUREs and examples are not meant to limit the scope of the present subject matter to a single embodiment, but other embodiments are possible by way of interchange of some or all of the described or illustrated elements and, further, wherein.

DETAILED DESCRIPTION OF ILLUSTRATIVE EMBODIMENTS

The detailed description set forth below in connection with the appended drawings is intended as a description of exemplary embodiments in which the presently disclosed process can be practiced. The term "exemplary" used throughout this description means "serving as an example, instance, or illustration," and should not necessarily be construed as preferred or advantageous over other embodiments. The detailed description includes specific details for providing a thorough understanding of the presently disclosed method and system. However, it will be apparent to those skilled in the art that the presently disclosed process may be practiced without these specific details. In some instances, well-known structures and devices are shown in block diagram form in order to avoid obscuring the concepts of the presently disclosed method and system.

In the present specification, an embodiment showing a singular component should not be considered limiting. Rather, the subject matter preferably encompasses other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present subject matter encompasses present and future known equivalents to the known components referred to herein by way of illustration.

For purposes of the present disclosure herein appear references to water-resistant, water proof, breathable waterproof, windproof and breathable, and combinations of the above. The purpose of these terms is not to be unduly limiting, but may include any material or construction wherein the purpose is to protect the contents of the presently disclosed compartmented beverage koozie from outside elements. This includes rain, snow, hail, wind, heat or other elements. So, where the term waterproof may be used, so too may the terms water-resistant, waterproof, windproof and different combinations of similar terms. When such terms are used, the related subject matter is not to be unduly limited, but is to include all such embodiments as be clearly within the scope the disclosed and claimed subject matter.

Figure 1:
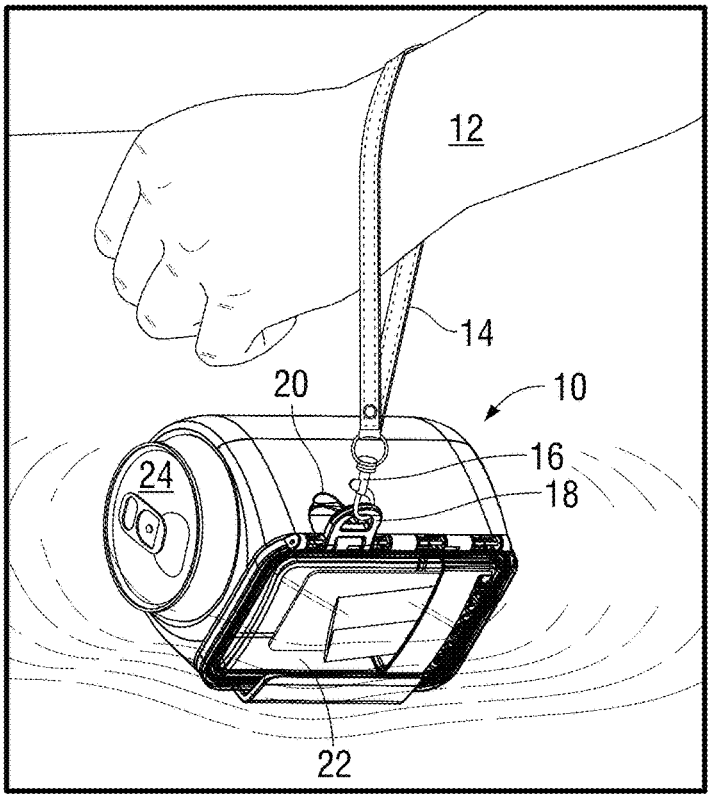
FIG. 1 illustrates a mode of using the compartmented beverage koozie of the present disclosure.

FIG. 1 illustrates a mode of using the compartmented beverage koozie 10 of the present disclosure. FIG. 1 shows compartmented beverage koozie 10, as a user may attach to his wrist 12 using strap or tether 14. Tether 14 includes hook 16 that engages D-ring 18. D-ring 18 is hinged and part of compartmented beverage koozie 10. Thus, compartmented beverage koozie 10 includes recessed 20 into watch D-ring 18 May be inserted. Compartment and beverage koozie 10 further includes transparent door 22. Beverage can 24 rests comfortably within koozie portion 26 of compartmented beverage koozie 10.

Figure 2:
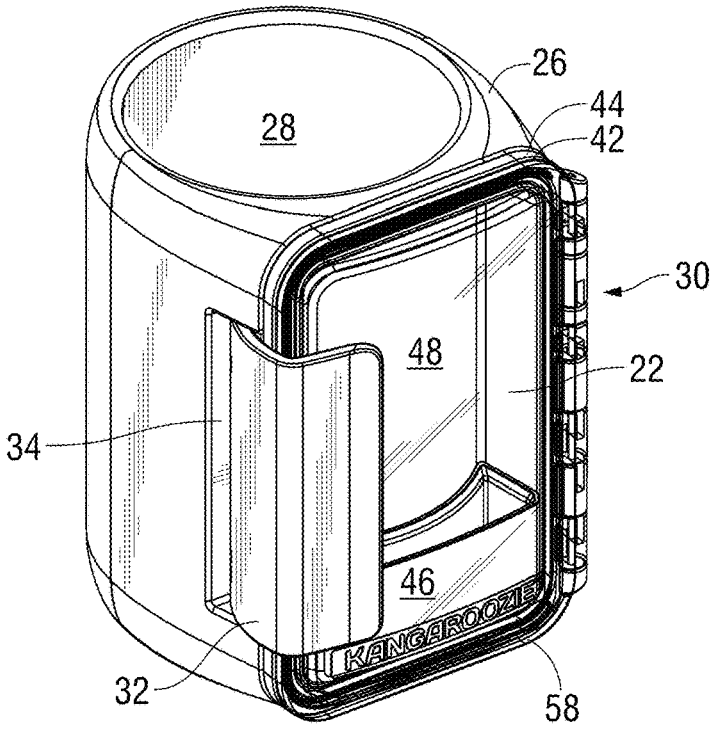
FIG. 2 depicts an isometric view of the compartmented beverage koozie of the present disclosure.

FIG. 2 depicts an isometric view of the compartmented beverage koozie 10 of the present disclosure. FIG. 2 shows compartmented beverage koozie 10 to more specifically include koozie portion 26 possessing cylindrical interior 28 for receiving beverage can 24. Integral to compartmented beverage koozie channel is compartment 30. Compartment 30 includes latch 32, which pivots on latch hinge 34. Transparent door 22 pivots on hinge 36, which is held in place using a set of hinge pens 38 and 40. Transparent door 22 includes gasket 42 which makes a seal with compartment opening 44. Within compartment 30 appears pocket 46 and larger space 48. In addition, transparent door 22 provides a logo or brand space 50, for placement of a brand or logo. This may provide convenient advertising space in the event that compartmented beverage koozie 10 may be offered as a promotional item.

Due to its design and engineering, compartmented beverage koozie 10 floats. Therefore, if compartmented beverage koozie 10 drops in the water, it will stay afloat, while keeping the items in waterproof compartment 30 secure and dry. This addition makes the compartmented beverage koozie 10 a safe device for carrying belongings while near or in water.

While the transparent door 22 allows for the user to see their belongings while the door is shut, it is also able to be used for marketing, promotion, or personal additions. A sticker may be placed on the inside or outside of transparent door 22—this will protect the user's belongings from being seen, but it will also allow for personalization through the sticker. The image on the sticker could be personalized, represent a company's name or logo for marketing, or have a sports team's logo, etc. The transparent door 22 being clear has multiple benefits, as it can be left as transparent, or used for other purposes (stickers, marketing, branding, etc.).

Figure 3:
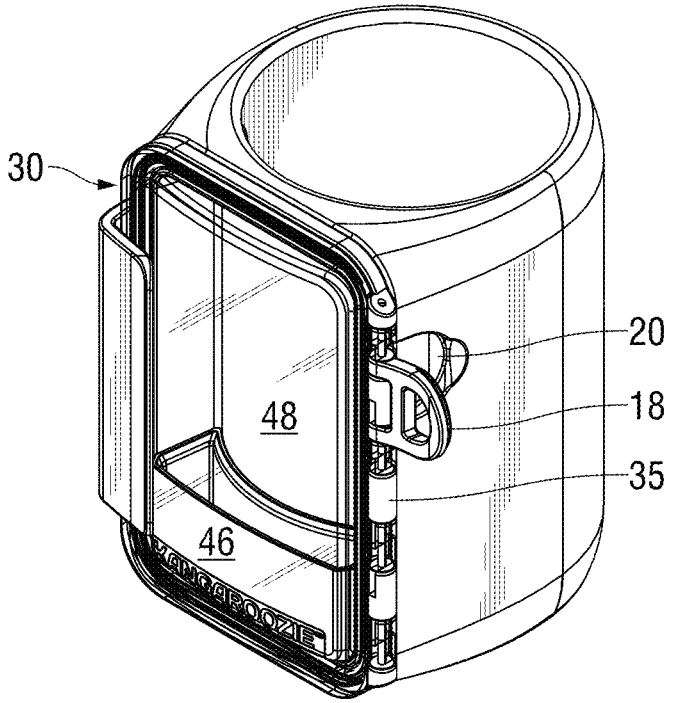
FIG. 3 exhibits an aspect of the hinged D-ring of the compartmented beverage koozie of the present disclosure.

FIG. 3 exhibits an aspect of the hinged D-ring of the compartmented beverage koozie of the present disclosure. FIG. 3 shows the arrangement of the D-ring 18 with recess 20. Note the D-ring 18 pivots on hinge 36. D-ring 18 may be pivoted to fit within D-ring recessed 20. Doing so maintains the flush or smooth surface profile of koozie portion 26.

D-ring 18 also allows for other items to be attached to compartmented beverage koozie 10. For example, if keys are too large to fit inside of the compartment, they could be attached to D-ring 18 through an attachment device, like a carabiner. D-ring can be used to carry extra items, or attach to a lanyard or wrist strap for secured carrying.

Figure 4:
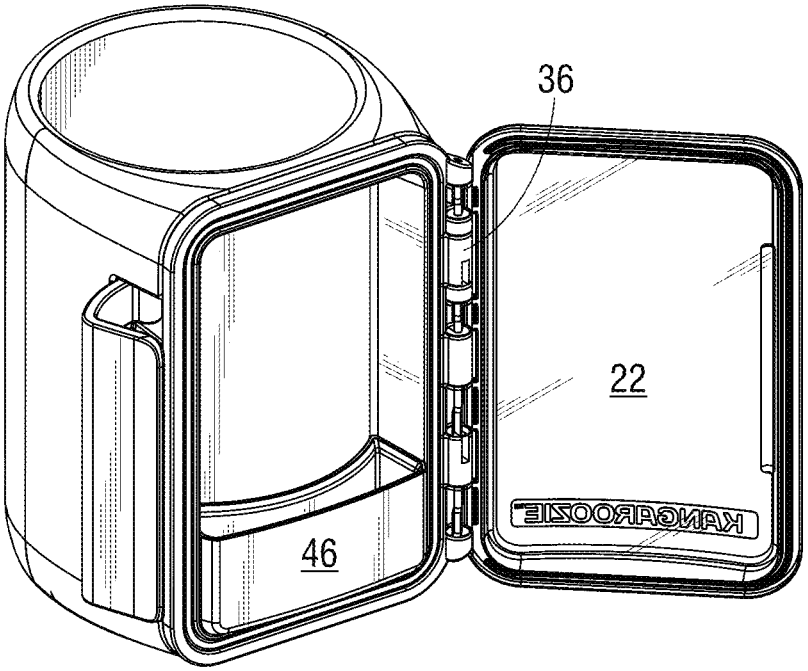
FIG. 4 illustrates the interior space of the compartmented beverage koozie of the present disclosure.

FIG. 4 illustrates the interior space of the compartmented beverage koozie of the present disclosure. FIG. 4 illustrates the fully open configuration of compartmented beverage koozie 10. Thus, by pivoting transparent door 22 on hinge 36, compartment 30 is accessible for pocket 46 to receive credit cards or keys or other smaller personal items, and larger compartment 48 may be available for larger items. Also, credit cards or keys or other personal items fit within pocket 46, where pocket 46 prevents the larger items from falling out of compartment 30.

Figure 5:
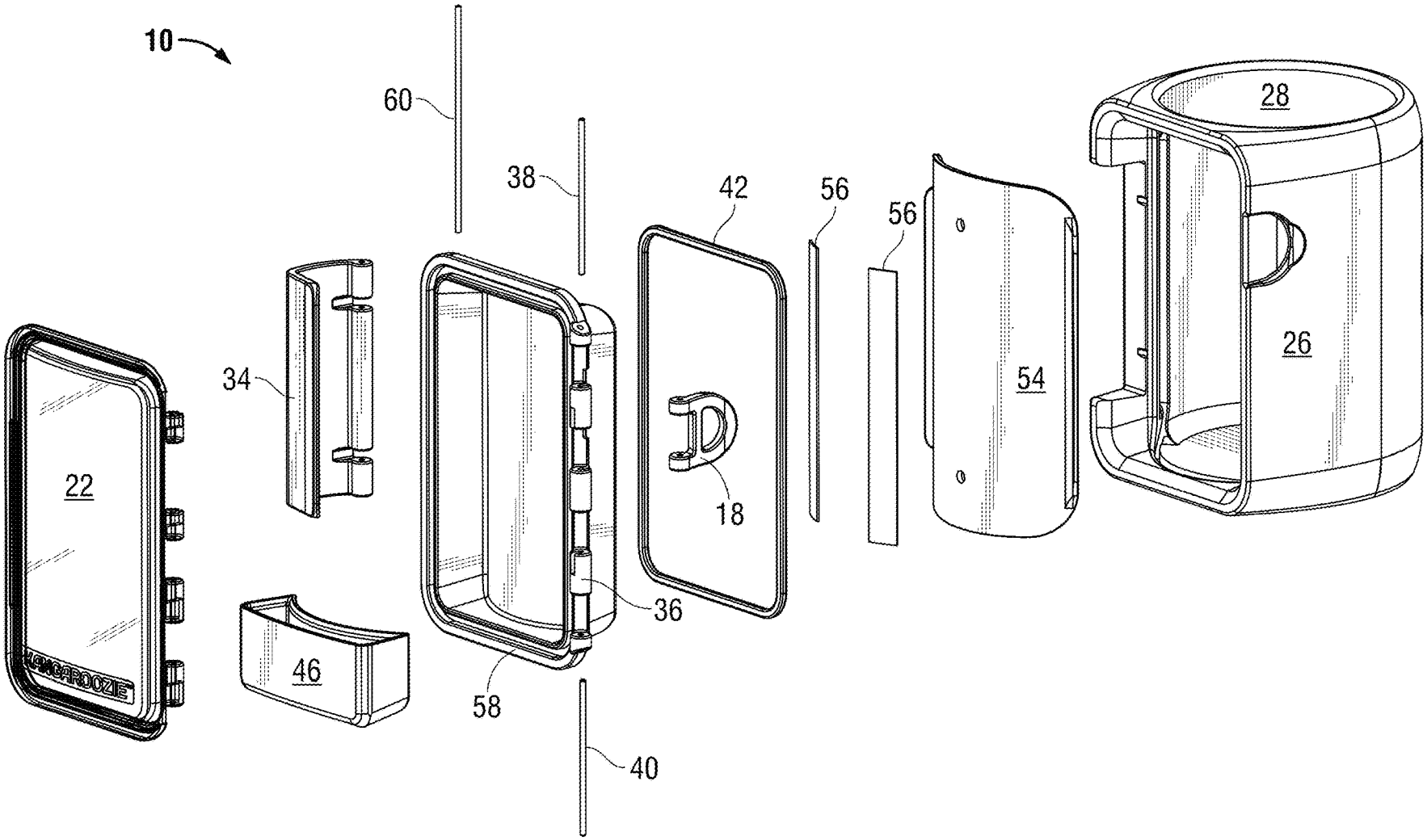
FIG. 5 is an exploded view of the constituent components forming the compartmented beverage koozie of the present disclosure.

FIG. 5 is an exploded view of the constituent components forming the compartmented beverage koozie of the present disclosure. FIG. 5 shows an exploded view of compartmented beverage koozie 10 to illustrate the component parts and how they associate with one another. Beginning a koozie portion 26, there is first curved plate 54 that fits within cylindrical interior 28. Double-sided adhesive strips 56 attach to curved plate 54. Gasket 42 fits on the interior side of transparent door 22 to seal with koozie opening exterior face 58. Upper hinge pin 38 and lower hinge pin 40 fit within door hinge base 36. Latch hinge pin 60 permits positioning latch 32 on latch hinge 34. Transparent door 22 engages door hinge 36 at door hinge portion 62.

Preferable materials for one embodiment of the presently disclosed compartmented beverage koozie 10 may be as follows: koozie portion 26 may be formed of a rubber or spongy, compressible synthetic material. Curved plate 54 may be form of PC-ABS (polycarbonate-ABS). Double-sided adhesive strips 56 may be formed from VHB tape, which may be a black, 0.045 in (1.1 mm) tape that is a modified acrylic adhesive and very conformable acrylic foam core bonds. Gasket 42 may be formed from silicon, such as a white shore A 20 high gloss silicone. Koozie opening exterior face 58 may be formed of PC-ABS. Upper hinge pin 38 and lower hinge pin 40 may be formed of stainless steel, as may be latch hinge pin 60. Positioning latch 32 may be formed of PC-ABS, as may be latch hinge 34. Transparent door 22 may be formed of Poly(methyl methacrylate) (PMMA), also known as acrylic or acrylic glass as well as by the trade names Plexiglas, Acrylite, Lucite, and Perspex among several others. PMMA is a transparent thermoplastic often used in sheet form as a lightweight or shatter-resistant alternative to glass. Door hinge portion 62 on transparent door 22 may also be formed of PMMA. Pocket 46 may be formed of silicone with a white satin texture.

Figure 6:
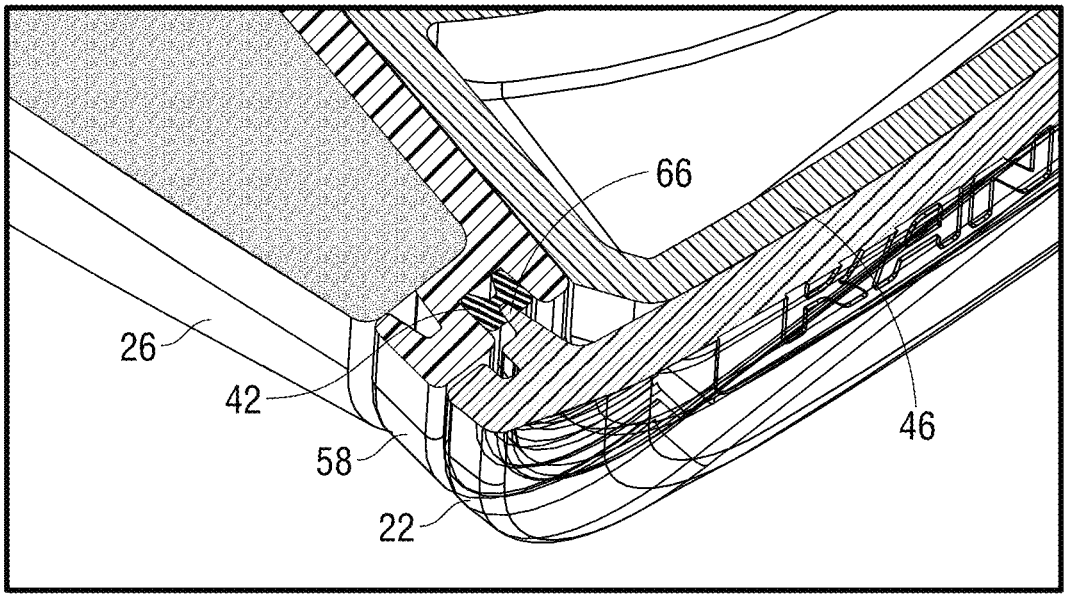
FIG. 6 shows a pictorial drawing water resistant seal between the transparent door and compartment volume of the present disclosure.

FIG. 6 shows a water resistant seal between the transparent door and compartment volume of the present disclosure. FIG. 6 illustrates the engagement of transparent door 22 with comportment opening 44. Note, that gasket 42 sets within gasket recess 64 to maintain its position within compartment opening 44. Transparent door 22 includes Gasket engagement protrusion 66. By engaging transparent door 22 in gasket 42 at gasket engagement protrusion 66. A water resistant or waterproof seal occurs between transparent door 22 and water resistant compartment 30.

Figure 7:
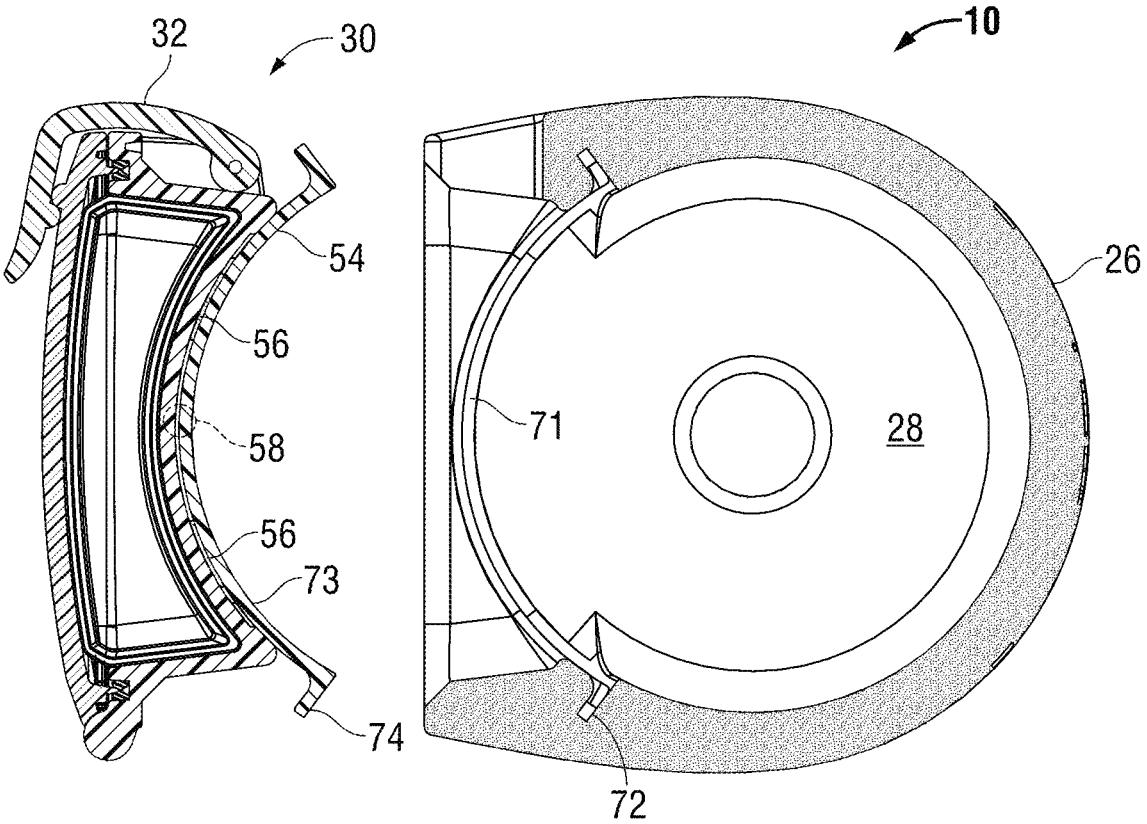
FIG. 7 provides top down perspective view of the compartmented beverage koozie of the present disclosure.

FIG. 7 provides top-down perspective view of the compartmented beverage koozie of the present disclosure. FIG. 7 shows the construction of compartmented beverage koozie 10 to illustrate the engagement of watertight compartments 30 with koozie portion 26. From a top-down perspective, koozie portion 26 surrounds cylindrical interior 28, which includes a cylinder wall 70. Curved plate 54 engages with foam koozie portion 26 at inserts portions 71 and 72. Curved plate 54 includes protrusions 72 and 74 which extend into inserts 71 and 72. Thus, koozie portion 26 may receive a beverage can within interior cylindrical interior 28. Compartment 30 attaches to curved plate 54 at interface 78. Because of being rigidly mounted with adhesive strips 56 to curved plate 54, compartment 30 now becomes an integral portion of the combined koozie portion 26 and compartment 30 to result in compartmented beverage koozie 10 of the present disclosure.

Figure 8:
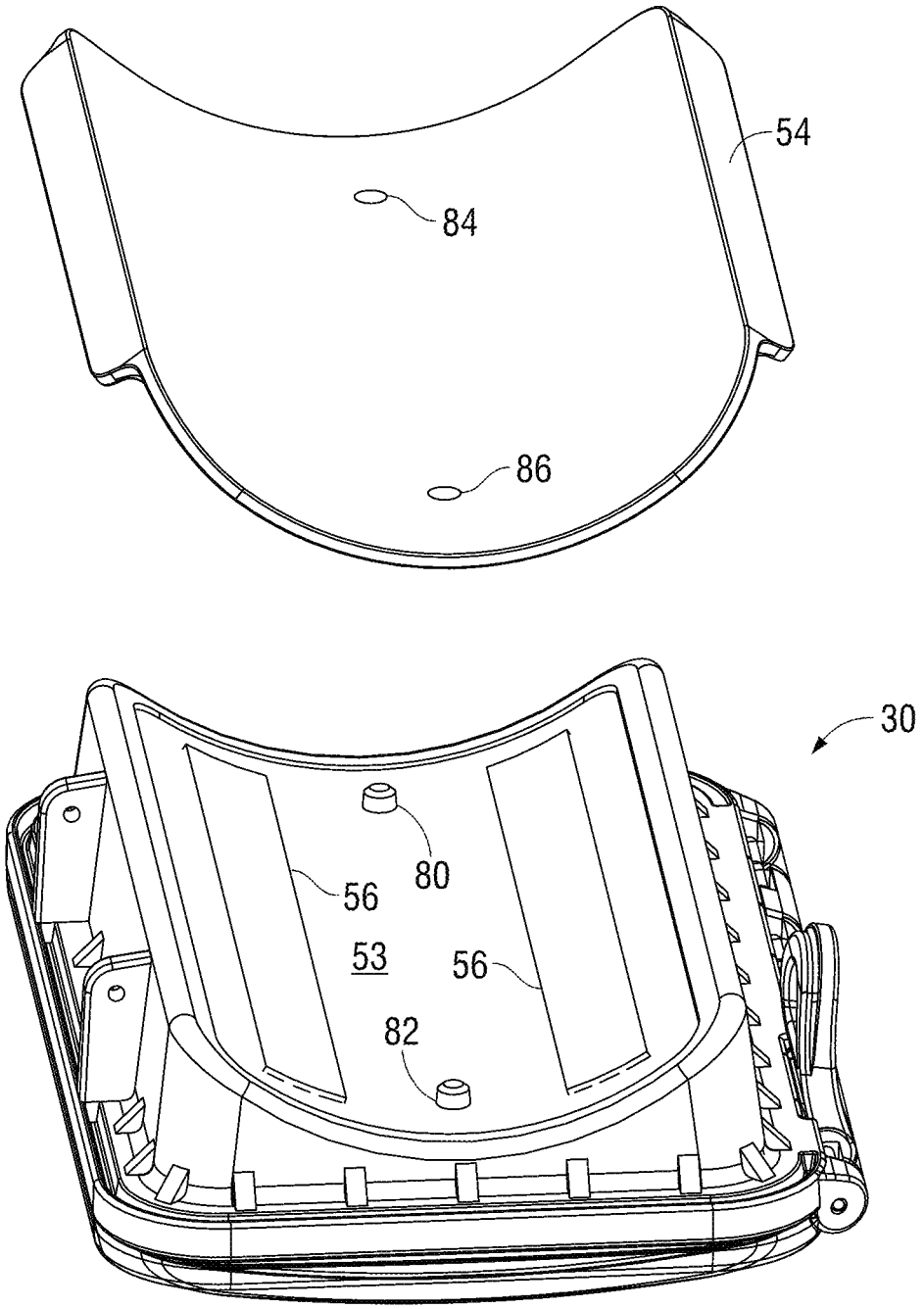
FIG. 8 illustrates the mating of the curved plate and water resistant curved surface according to the teachings of the present disclosure.

FIG. 8 illustrates the mating of the curved plate 54 and compartment 30 curved surface 83 according to the teachings of the present disclosure. FIG. 8 shows the interface between curved plate 54 and compartment 30. FIG. 8 shows the positioning of adhesive strips 56, as well as the configuration of registration tips 80 and 82 on curved surface 83 that align with curved plate 54 engagement recesses 84 and 86. The result of adhesive strips 56 and the alignment tips 80 and 82 with recesses 84 and 86, respectively is a durable construction capable service in a wide variety of temperatures and weather conditions.

The compartmented beverage koozie is ideal for holding cash, credit and debit cards, identification, house keys, some car keys, hotel cards/keys, essentially anything small that a person absolutely needs to have with him. Uses include on the beach, when tailgating, at the river, while fishing, when hiking, at the lake, camping, and on vacations. The compartmented beverage koozie is particularly well-suited for water, sand, snow, and dirt made for all conditions.

In several embodiments, the compartmented beverage koozie is made of high-quality foam that is waterproof, non-absorbent, ultra-light-white, scratch and tear assistant, buoyant and anti-microbial. The compartmented beverage koozie is strong and durable for enduring all the challenges of nature, including fresh, salt, and chlorinated water, as well as mud, dirt and sand.

In summary, here has been shown a compartmented beverage koozie with a protective compartment that secures personal items while insulating a beverage. The koozie includes a body with a bottom and a cylindrical vertical side defining a cylindrical interior that receives and maintains the temperature of the beverage. A curved plate forms a rigid mounting structure conforming to the cylindrical interior of the koozie. A cylindrical vertical side opening exposes the curved plate. A water-resistant compartment includes a height not greater than the approximate height of the cylindrical vertical side and a curved exterior side conforming to the curvature of the curved plate. This joins the curved exterior side through the cylindrical vertical side opening to form thereby the water-resistant compartment as an integral structure of the koozie. The water-resistant compartment of sufficient size to receive and secure personal items and retain the personal items in physical proximity to the koozie, while preventing or substantially reducing exposure of the personal items to water or other environmental effects. The water-resistant compartment further includes a transparent door for showing the personal items protected within the water-resistant compartment and a gasket for preventing or substantially reducing water or other environment effects damage to the personal items protected by the water-resistant compartment. The water-resistant compartment further includes a door latch and gasket assembly for securely closing and establishing a water-resistant enclosure. The koozie further includes a resilient and compressible foam structure having a low thermal transfer coefficient for preserving the thermal state of the beverage within the cylindrical interior. The water-resistant compartment further includes a pocket for holding smaller personal items and a larger compartment for holding credit cards, paper money, and other larger personal items. A D-ring receives a tether or carabiner for permitting single-attachment transport of said compartmented beverage koozie.

It will be apparent to those skilled in the art that various modifications and variations can be made in the present disclosure without departing from the scope or spirit of the disclosure. Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

The detailed description set forth here, in connection with the appended drawings, is intended as a description of exemplary embodiments in which the presently disclosed subject matter may be practiced. The term "exemplary" used throughout this description means "serving as an example, instance, or illustration," and should not necessarily be construed as preferred or advantageous over other embodiments.

This detailed description of illustrative embodiments includes specific details for providing a thorough understanding of the presently disclosed subject matter. However, it will be apparent to those skilled in the art that the presently disclosed subject matter may be practiced without these specific details. In some instances, well-known structures and devices are shown in block diagram form in order to avoid obscuring the concepts of the presently disclosed method and system.

The foregoing description of embodiments is provided to enable any person skilled in the art to make and use the subject matter. Various modifications to these embodiments will be readily apparent to those skilled in the art, and the novel principles and subject matter disclosed herein may be applied to other embodiments without the use of the innovative faculty. The claimed subject matter set forth in the claims is not intended to be limited to the embodiments shown herein, but is to be accorded the widest scope consistent with the principles and novel features disclosed herein. It is contemplated that additional embodiments are within the spirit and true scope of the disclosed subject matter.

What is claimed is:

1. A compartmented beverage koozie with protective compartment for securing personal items, comprising:

a koozie for insulating a beverage, said koozie comprising a body with a bottom and a cylindrical vertical side defining a cylindrical interior for receiving and maintaining the temperature of a beverage, and said koozie comprising inserts portions;

a curved plate forming a rigid mounting structure conforming to the cylindrical interior of said koozie, said curved plate exposed through a cylindrical vertical side opening, said curved plate comprising protrusions and recesses, and said protrusions extending from ends of said curved plate and entering into said inserts portions for fitting said curved plate within said cylindrical interior of said koozie;

a water-resistant compartment comprising a height not greater than the approximate height of said cylindrical vertical side and a curved exterior side conforming to the curvature of said curved plate for joining said curved exterior side through said cylindrical vertical side opening via double-sided adhesive strips and tips, said tips positioning at the curved exterior side and aligning with said recesses of said curved plate, and said double-sided adhesive strips and said tips forming said water-resistant compartment as an integral structure of said koozie, said water-resistant compartment of sufficient size to receive and secure personal items and retain said personal items in physical proximity to said koozie while preventing or substantially reducing exposure of said personal items to water or other environmental effects.

2. The compartmented beverage koozie with protective compartment of claim 1, wherein said water-resistant compartment further comprises a transparent door for showing said personal items protected within said water-resistant compartment.

3. The compartmented beverage koozie with protective compartment of claim 1, wherein said water-resistant compartment further comprises a transparent door for showing said personal items protected within said water-resistant compartment, said transparent door further comprising a gasket for preventing or substantially reducing water or other environment effects damage to the personal items protected by said water-resistant compartment.

4. The compartmented beverage koozie with protective compartment of claim 1, wherein said koozie further comprises a resilient and compressible foam structure having a low thermal transfer coefficient for preserving the thermal state of the beverage within said cylindrical interior.

5. The compartmented beverage koozie with protective compartment of claim 1, wherein said water-resistant compartment further comprises a pocket for holding smaller personal items and a larger compartment for holding credit cards, paper money, and other larger personal items.

6. The compartmented beverage koozie with protective compartment of claim 1, wherein said water-resistant compartment further comprises a D-ring for receiving a tether or carabiner for permitting single-attachment transport of said compartmented beverage koozie.

7. The compartmented beverage koozie with protective compartment of claim 1, wherein said water-resistant compartment further comprises a transparent door latch and gasket assembly for securely closing and establishing a water-resistant enclosure for said personal items protected within said water-resistant compartment.

8. A method for securing personal items in proximity to a compartmented beverage koozie with protection against water or other environment effects, comprising the steps of:

a koozie for insulating a beverage, said koozie comprising a body with a bottom and a cylindrical vertical side defining a cylindrical interior for receiving and maintaining the temperature of a beverage, and said koozie comprising inserts portions;

a curved plate forming a rigid mounting structure conforming to the cylindrical interior of said koozie, said curved plate exposed through a cylindrical vertical side opening, said curved plate comprising protrusions and recesses, and said protrusions extending from ends of said curved plate and entering into said inserts portions for fitting said curved plate within said cylindrical interior of said koozie;

a water-resistant compartment comprising a height not greater than the approximate height of said cylindrical vertical side and a curved exterior side conforming to the curvature of said curved plate for joining said curved exterior side through said cylindrical vertical side opening via double-sided adhesive strips and tips, said tips positioning at the curved exterior side and aligning with said recesses of said curved plate, and said double-sided adhesive strips and said tips forming said water-resistant compartment as an integral structure of said koozie, said water-resistant compartment of sufficient size to receive and secure personal items and retain said personal items in physical proximity to said koozie while preventing or substantially reducing exposure of said personal items to water or other environmental effects.

9. The method for securing personal items in proximity to a compartmented beverage koozie with protection against water or other environment effects of claim 8, further comprising the step of, wherein said water-resistant compartment further comprises a transparent door for showing said personal items protected within said water-resistant compartment.

10. The method for securing personal items in proximity to a compartmented beverage koozie with protection against water or other environment effects of claim 8, further comprising the step of wherein said water-resistant compartment further comprises a transparent door for showing said personal items protected within said water-resistant compartment, said transparent door further comprising a gasket for preventing or substantially reducing water or other environment effects damage to the personal items protected by said water-resistant compartment.

11. The method for securing personal items in proximity to a compartmented beverage koozie with protection against water or other environment effects of claim 8, further comprising the step of, wherein said koozie further comprises a resilient and compressible foam structure having a low thermal transfer coefficient for preserving the thermal state of the beverage within said cylindrical interior.

12. The method for securing personal items in proximity to a compartmented beverage koozie with protection against water or other environment effects of claim 8, further comprising the step of, wherein said water-resistant compartment further comprises a pocket for holding smaller personal items and a larger compartment for holding credit cards, paper money, and other larger personal items.

13. The method for securing personal items in proximity to a compartmented beverage koozie with protection against water or other environment effects of claim 8, further comprising the step of, wherein said water-resistant compartment further comprises a D-ring for receiving a tether or carabiner for permitting single-attachment transport of said compartmented beverage koozie.

14. The method for securing personal items in proximity to a compartmented beverage koozie with protection against water or other environment effects of claim 8, further comprising the step of, wherein said water-resistant compartment further comprises a transparent door latch and gasket assembly for securely closing and establishing a water-resistant enclosure for said personal items protected within said water-resistant compartment.

15. A portable system for securing personal items in proximity to a compartmented beverage koozie with protection against water or other environment effects, the system comprising:

a koozie for insulating a beverage, said koozie comprising a body with a bottom and a cylindrical vertical side defining a cylindrical interior for receiving and maintaining the temperature of a beverage, and said koozie comprising inserts portions;

a curved plate forming a rigid mounting structure conforming to the cylindrical interior of said koozie, said curved plate exposed through a cylindrical vertical side opening, said curved plate comprising protrusions and recesses, and said protrusions extending from ends of said curved plate and entering into said inserts portions for fitting said curved plate within said cylindrical interior of said koozie;

a water-resistant compartment comprising a height not greater than the approximate height of said cylindrical vertical side and a curved exterior side conforming to the curvature of said curved plate for joining said curved exterior side through said cylindrical vertical side opening via double-sided adhesive strips and tips, said tips positioning at the curved exterior side and aligning with said recesses of said curved plate, and said double-sided adhesive strips and said tips forming said water-resistant compartment as an integral structure of said koozie, said water-resistant compartment of sufficient size to receive and secure personal items and retain said personal items in physical proximity to said koozie while preventing or substantially reducing exposure of said personal items to water or other environmental effects; and further a lanyard or tether connecting to said compartmented beverage koozie with water-resistant compartment for permitting easy transport and securing to a transporting individual or moving structure.

16. The portable system for securing personal items of claim 15, wherein said water-resistant compartment further comprises a transparent door for showing said personal items protected within said water-resistant compartment.

17. The portable system for securing personal items of claim 15, wherein said water-resistant compartment further comprises a transparent door for showing said personal items protected within said water-resistant compartment, said transparent door further comprising a gasket for preventing or substantially reducing water or other environment effects damage to the personal items protected by said water-resistant compartment.

18. The portable system for securing personal items of claim 15, wherein said koozie further comprises a resilient and compressible foam structure having a low thermal transfer coefficient for preserving the thermal state of the beverage within said cylindrical interior.

* * * * *